United States Patent [19]

Bruntmyer

[11] 4,077,155

[45] Mar. 7, 1978

[54] AERODYNAMIC TOY

[76] Inventor: Joseph A. Bruntmyer, 149 S. Madison, Adrian, Mich. 49221

[21] Appl. No.: 707,831

[22] Filed: Jul. 22, 1976

[51] Int. Cl.[2] ..... A63H 33/60

[52] U.S. Cl. ..... 46/74 R; 46/74 D; 46/86 R

[58] Field of Search ..... 46/74 D, 82, 84, 51, 46/86 R; 124/79

[56] References Cited

U.S. PATENT DOCUMENTS

| | | | |
|---|---|---|---|
| 2,744,356 | 5/1956 | Killinger et al. | 46/74 D |
| 3,113,396 | 12/1963 | Collins | 46/74 |
| 3,182,422 | 5/1965 | Ryan | 46/84 |
| 3,959,918 | 6/1976 | Ortiz | 46/74 D |

*Primary Examiner*—Louis G. Mancene

*Assistant Examiner*—Robert F. Cutting

*Attorney, Agent, or Firm*—Gifford, Chandler, Sheridan & Sprinkle

[57] ABSTRACT

An aerodynamic toy comprising a disc shaped aerodynamic throwing implement of the type adapted to rotate about its axis upon an airborne flight and a member which detaches from the implement after a predetermined number of revolutions of said implement. The member carries a nut which threadably engages a threaded shaft coaxially secured to the rotational axis of the implement. An air foil is rotatably coupled to the threaded shaft and prevents the rotation of the member despite rotation of the implement during flight. Following a predetermined number of revolutions of the implement, the member unscrews from the threaded shaft and descends to the ground via a parachute attached to the member.

10 Claims, 6 Drawing Figures

AERODYNAMIC TOY

BACKGROUND OF THE INVENTION

I. Field of the Invention

The present invention relates generally to aerodynamic toys adapted to rotate about their axes during flight and, more particularly, to such a toy having a member coupled thereto which detaches from the toy after a predetermined number of revolutions of the toy.

II. Description of the Prior Art

Over the past several years, toys resembling saucers have become quite popular as throwing implements. The typical implement is constructed of a plastic material and, when viewed in elevation, approximates the shape of an air foil.

The toy is used in throwing games and is normally gripped around the rim of the saucer. Throwing is usually accomplished with a wrist snapping motion whereby the thrower imparts a spinning motion to the saucer to cause it to fly.

One disadvantage of these flying toys is that such toys are limited to aerodynamic maneuvers. Since the number of different aerodynamics manuevers for the toy are limited, in practice, children rapidly tire of the throwing game.

SUMMARY OF THE PRESENT INVENTION

The present invention provides a novel aerodynamic toy designed to provide hours of enjoyment for both children and adults.

In brief, the aerodynamic toy of the present invention comprises a disc-shape throwing implement of the type adapted to rotate about its axis upon an airborne flight. A threaded shaft is attached to and extends coaxially outward from the axis of rotation of the implement and threadably engages a member mounted above the implement. A parachute is attached to the member and both the member and the parachute are carried by an air foil disposed between the member and throwing implement. The air foil is slidably mounted to the shaft and is designed to resist rotation despite rotation of the throwing implement.

In a modification of the invention, the air foil forms a part of the member and again functions to prevent rotation of the member.

In operation, as the throwing implement is projected into the air upon an airborne flight, the throwing implement rotates about its axis while both the air foil and the member remain rotationally stable. Consequently, following a predetermined number of revolutions of the throwing implement, the threaded shaft unscrews and disengages from the member thereby detaching the member from the throwing implement in midflight. In the preferred form of the invention, the member thereafter floats to the ground by means of the parachute whereas in a modification of the invention the member includes wings or the like to glide to the ground.

Following an airborne flight of the throwing implement and detachment of the member from the throwing implement, the member can be easily, simply, and rapidly reattached to the implement by rescrewing the member onto the shaft.

BRIEF DESCRIPTION OF THE DRAWINGS

A better understanding of the present invention will be had upon reference to the following detailed description when read in conjunction with the accompanying drawing wherein like reference characters refer to like parts throughout the several views, and in which.

DETAILED DESCRIPTION OF THE PRESENT INVENTION

Figure 1:
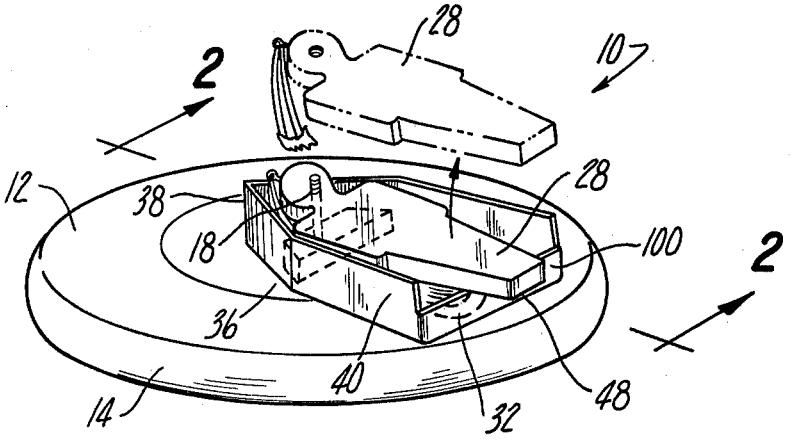
FIG. 1 is a perspective view showing the aerodynamic toy of the present invention.
Figure 2:
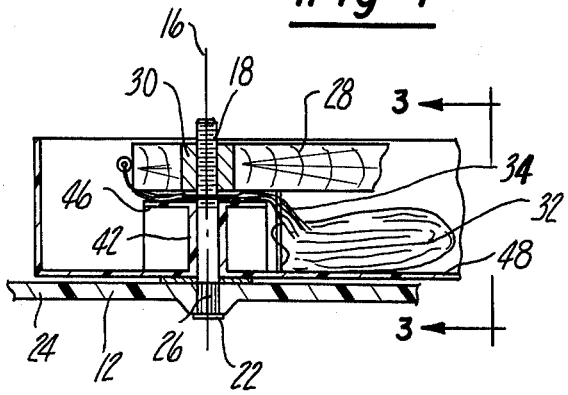
FIG. 2 is a sectional view of the toy of the present invention taken substantially along line 2—2 of FIG. 1.
Figure 3:
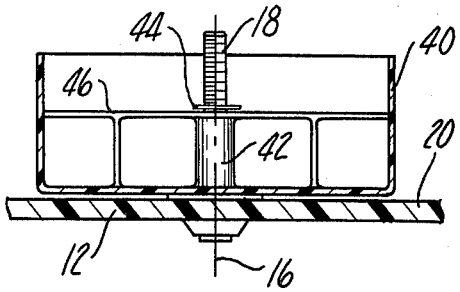
FIG. 3 is a fragmentary sectional view of the toy of the present invention taken substantially along line 3—3 in FIG. 2.

Referring first to FIGS. 1–3, the aerodynamic toy 10 of the present invention is there shown and comprises a disc-shaped throwing implement 12. The implement 12 includes a rim 14 about its periphery so that when viewed in elevation, the implement 12 approximates an air foil. The implement 12 is available commercially and is typically projected into the air by grasping the implement 12 by its rim 14 and throwing the implement outward by a wrist snapping motion. Consequently, during an airborne flight, the implement 12 rotates about its axis 16 of rotation.

As best shown in FIGS. 2 and 3, an exteriorly threaded shank 18 is secured to the implement 12 so that the shank 18 extends outward from the upper surface 20 of the implement 12 coaxially with the axis of rotation 16 of the implement 12. Although the shank 18 may be attached to the implement 12 by any appropriate means, as shown, the shank 18 includes an enlarged diameter head portion 22 which abuts against the inner surface 24 of the implement 12 and a plurality of splines 26 which frictionally engage the implement 12. With this construction the shank 18 is secured against rotation to the implement 12.

Referring particularly to FIGS. 1 and 2, a member 28, for example, constructed in a human shape, includes an internally threaded sleeve or nut 30 which threadably cooperates with the shank 18. Thus by rotating the member 28 with respect to the implement 12, the member 28 can be screwed onto the shank 18 as shown in solid line in FIG. 1 or rotated off from the shank 18 as shown in phantom line in FIG. 1. In addition in the preferred form of the invention, a parachute 32 is connected to the member 28 by shroud lines 34, the operation of which will be subsequently described.

An air foil 36 having a pointed nose portion 38 and side panels 40 is sandwiched between the member 28 and the implement 12. The air foil 36 is freely rotatably connected to the shank 18 by any appropriate means such as tubular cylindrical sleeve 42 disposed around the shank 18. A retainer clip 44 is secured to the shank 18 above the air foil 36 to prevent detachment of the air foil 36 of the implement 12.

The air foil 36 is open at its top and carries both the member 28 and the parachute 32 therein. Due to the free rotatable connection between the implement 12 and the air foil 36, the pointed portion 38 will point in the direction of the flight of the implement 12 and resist rotation despite the rotation of the implement 12. In addition, as best shown in FIG. 2, the air foil 36 preferably includes a raised portion 46 which supports the member 28 while the parachute 32 is packed between the member 28 and the base 48 of the air foil 36. Moreover, a back wall or baffle 100 across the open rear end of the air foil 36 prevents the parachute 32 from falling out from the air foil 36.

Figure 4:
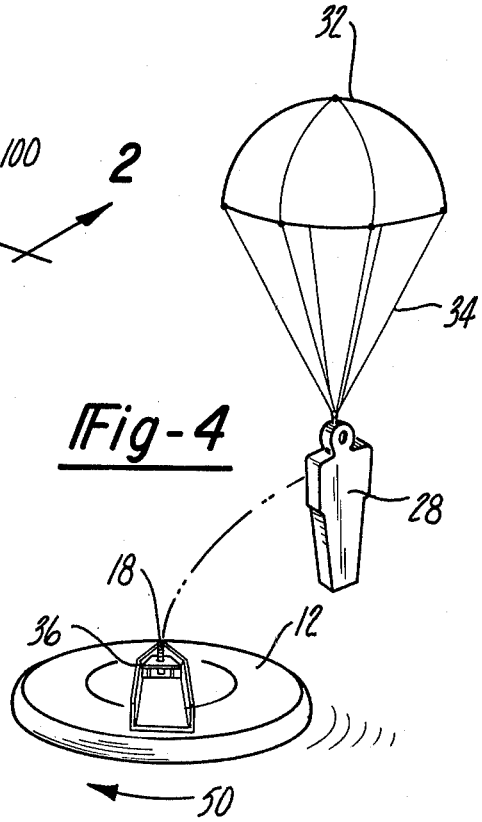
FIG. 4 is a perspective view of the toy of the present invention and showing the toy in one phase of an airborne flight.

With reference to FIGS. 1 and 4, the operation of the aerodynamic toy 10 is as follows. The member 28 is first rotated onto the threaded shank 18 to the position shown in solid line in FIG. 1 so that the member 28 is both carried by the air foil 36 and with the parachute 32 packed between the member 28 and the base 48 of the air foil 36.

When projected upon an airborne flight, the implement 12 rotates in a clockwise direction shown by arrow 50 around its axis of rotation 16. The air foil 36, due to its freely rotatable attachment to the shank 18, resists the rotation of the implement 12, and likewise, prevents rotation of the member 28 with the implement 12. Consequently, after a predetermined number of revolutions of the implement 12, the member 28 unscrews from the threaded shank 18 and detaches from the implement 12. The implement 12 thereafter continues on its flight while the member 28 floats downward to the ground by means of the parachute 32. The retainer clip 44, of course, retains the air foil 36 to the implement 12.

Figure 5:
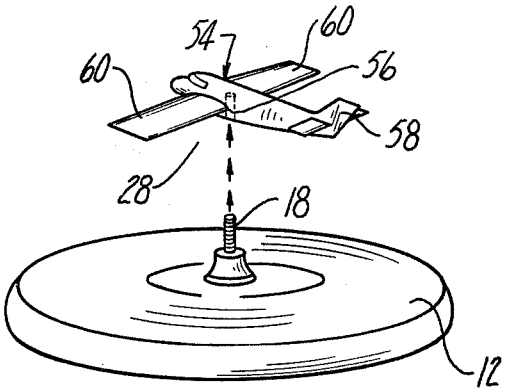
FIG. 5 is a perspective view showing the toy of the present invention similar to FIG. 4, but showing a modification thereof.

A modification of the toy 10 of the present invention is illustrated in FIG. 5 and comprises an airplane 54 having an internally threaded bore 56 which threadably engages the shank 18. In this modification of the invention, however, the tail section 58 of the airplane 54 serves as the air foil and prevents rotation of the airplane 54 despite rotation of the implement 12. Similarly the wings 60 serve to glide the airplane 54 to the ground in lieu of the parachute of the preferred embodiment.

Figure 6:
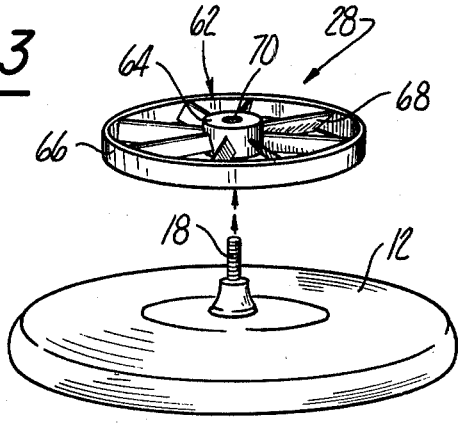
FIG. 6 is a perspective view showing the toy of the present invention similar to both FIGS. 4 and 5 but showing a still further modification thereof.

A still further modification of the present invention is illustrated in FIG. 6 in which the member 28 comprises an annular member 62 having an inner hub 64, outer annular ring 66, and a plurality of blades 68 extending radially outward from the hub 64 to the annular ring 66. The hub 64 includes an internally threaded bore 70 which threadably engages the shank 18 in the already described manner. Upon rotation of the implement 12 during an airborne flight, the blades 68 resist the rotation of the implement 12 thus unscrewing and detaching the annular member 62 from the shank 18. After detachment, the blades 68 rapidly rotate the annular member 62 during descent thereby floating the annular member 62 to the ground.

The novel aerodynamic toy of the present invention thus can provide hours of enjoyment for both children and adults. For example, by altering the number of turns the member 28 is screwed onto the shank 18, the exact point of detachment of the member 28 from the implement 12 can be varied. Numerous games of skill with the toy 10 thus become readily apparent, such as, for example, landing the member 28 on a desired target on the ground.

Having thus described my invention, many modifications thereto will become apparent to those skilled in the art to which it pertains without deviation from the spirit of the invention as defined by the scope of the appended claims.

I claim:

1. A toy comprising a disc shaped aerodynamic throwing implement having an upper substantially circular side and a lower substantially circular side and being of the type adapted to rotate about an axis upon an airborne flight, said axis being substantially perpendicular to and through the center of said disc shaped implement, a member attached to and carried by one side of said implement, and means for detaching and separating said member from said implement at a predetermined number of revolutions of said implement.

2. The invention as defined in claim 1 wherein said member includes means for floating on air.

3. The invention as defined in claim 1 and including means for preventing rotation of said member upon an airborne flight of said implement.

4. The invention as defined in claim 3 wherein said detaching means comprises a first threaded member fixed to said implement and a second threaded member fixed to said attached member, wherein said first threaded member threadably engages said second threaded member.

5. The invention as defined in claim 4 wherein one of said threaded members is a threaded shank while the other of said threaded members is a nut.

6. The invention as defined in claim 5 wherein said first and second threaded members are coaxial with the axis of rotation of said implement.

7. The invention as defined in claim 3 wherein said last mentioned means comprises an air foil attached to said member.

8. The invention as defined in claim 3 wherein said last mentioned means comprises an air foil rotatably coupled to said implement and adapted to carry said member.

9. The invention as defined in claim 2 wherein said last mentioned means comprises a parachute operatively coupled to said member.

10. The invention as defined in claim 2 wherein said last mentioned means comprises gliding wings coupled to said member.

* * * * *